United States Patent [19]

Larson

[11] 3,976,393

[45] Aug. 24, 1976

[54] PORTABLE FAN HOUSING

[75] Inventor: Dale Leonard Milton Larson, Harrow, Canada

[73] Assignee: Candaian Hurricane Equipment Ltd, Harrow, Canada

[22] Filed: Aug. 27, 1975

[21] Appl. No.: 608,146

[52] U.S. Cl. ..... 415/119; 415/209; 415/210; 415/219 R; 417/423 R

[51] Int. Cl.[2] ..... F04D 29/66; F04D 29/52

[58] Field of Search..... 415/119, 208, 209, 219 R, 415/219 C, 201, 210; 417/423 R

[56] References Cited

UNITED STATES PATENTS

| | | | |
|---|---|---|---|
| 1,978,459 | 10/1934 | Hegan | 415/219 C |
| 2,225,398 | 12/1940 | Hamblin | 415/119 |
| 2,650,020 | 8/1953 | Morrill | 415/219 R |
| 2,650,021 | 8/1953 | Morrill | 415/219 R |
| 3,019,965 | 2/1962 | Lyman | 417/423 R |
| 3,346,174 | 10/1967 | Lievens et al. | 415/119 |
| 3,403,843 | 10/1968 | Cox | 415/219 R |
| 3,433,403 | 3/1969 | Gerlitz | 415/119 |

FOREIGN PATENTS OR APPLICATIONS

| | | | |
|---|---|---|---|
| 513,686 | 2/1955 | Italy | 415/201 |
| 908,521 | 10/1962 | United Kingdom | 415/119 |

*Primary Examiner*—Henry F. Raduazo

[57] ABSTRACT

A barrel assembly for an axial flow fan comprises a sheet of flexible material, a body portion and a vane assembly. The body portion has a circular inlet and a barrel seat extending downstream from the periphery of the inlet. The vane assembly has a plurality of evenly spaced-apart radially extending vanes. The vanes are of equal radial length and each has a free end. The longitudinal axis of the vane assembly is coincident with the central axis of the inlet. The circumference of the circle containing the free ends of the vanes is substantially equal to the circumference of the barrel seat. The sheet of material wrapped around the free ends of the vanes is also wrapped around the barrel seat. Means for retaining the sheet of material in position is provided. A cabinet may be provided for the barrel assembly. The closed cavity between the barrel assembly and the interior surfaces of the cabinet may be filled with vibration absorbing material for supporting the barrel assembly.

30 Claims, 3 Drawing Figures

PORTABLE FAN HOUSING

FIELD OF INVENTION

This invention relates to a barrel assembly for an axial flow fan, and an insulated cabinet enclosure for supporting a barrel assembly in it.

BACKGROUND OF THE INVENTION

Fan tip clearance in an axial flow fan has a considerable effect on fan efficiency. For example, an axial flow fan with a tip clearance of 2% of the fan diameter will only produce about 60% of the pressure of a fan unit with a tip clearance of 0.1% of the diameter of the fan. Large tip clearances can produce premature stall conditions in the fan blades due to turbulent flow, particularly at the outer extremity of the fan blades where a higher percentage of the work is done on the air. Large tip clearances also contribute substantially to noise generation.

Small tip clearances in axial flow fans have been obtained by casting an axial flow fan barrel and machining the inside surface of the barrel so that its centre is concentric with the fan shaft centre and its diameter is very close to the diameter of the fan. Axial flow fans may also be formed by metal spinning where the centre of the formed barrel is concentric with the fan shaft centre. Other methods include using rings which support the fan in the barrel and which are shiftable to permit placing of the axis of the fan coincident with the axis of the barrel. These methods produce acceptable axial flow fans, however, they are very costly and complex.

With the above methods of manufacturing axial flow fan barrels, a compromise is usually reached between optimizing the configuration of the barrel and reducing the manufacturing costs. This results in the manufacture of axial flow fan barrels which have larger than desired tip clearances, undesirable noise generation and a less efficient fan.

It is therefore an object of the invention to provide an easy-to-assemble barrel for an axial flow fan which provides minimum tip clearance with resultant increase in efficiency and performance and reduction in noise generation at a relatively low cost of manufacture.

It is another object of the invention to provide a barrel assembly which may be dimensioned for use in large and small axial flow fans.

It is a further object of the invention to provide a barrel assembly for an axial flow fan which is readily assembled and retains its shape.

It is yet another object of the invention to provide an insulated cabinet for an axial flow fan barrel assembly where the insulation structurally supports the barrel assembly in the cabinet and which dampens most noise and vibrations produced by the fan.

It is another object of the invention to provide an insulated cabinet enclosure for an axial flow fan barrel where the insulation structurally supports the barrel assembly in the cabinet and absorbs shock loads.

It is another object of the invention to provide a method for insulating a cabinet enclosing an axial flow fan barrel assembly.

It is another object of the invention to provide a vane assembly for an axial flow fan which has evenly spaced-apart, equally radially-extending vane members.

SUMMARY OF THE INVENTION

The barrel assembly according to this invention for an axial flow fan comprises a sheet of flexible material, a body portion and a vane assembly. The body portion has a circular inlet and a barrel seat extending downstream from the periphery of the inlet. The vane assembly has a plurality of spaced-apart, radially-extending vanes. The vanes are of substantially equal radial length and each has a free end. The longitudinal axis of the vane assembly is coincident with the central axis of the inlet. The sheet of material is wrapped around the free ends of the vanes and the so-formed tubular end of the sheet of material is positioned in contacting and shape-holding relationship with the barrel seat. Means is provided for retaining the sheet of material in position.

The sheet of material which forms the barrel may be butt-joined or overlapped. A butt joint provides for smaller fan tip clearances.

The vanes of the vane assembly support the sheet of material in the desired circular shape. Depending upon the size of the barrel and the flexibility of the sheet of material, there may be two or more vanes on the vane assembly which are preferably evenly spaced apart. For example, with a very thin flexible sheet of material, several vanes may be required to retain the sheet of material in a smooth circular configuration when the sheet of material is clamped around the free ends of the vane assembly.

The body portion of the barrel assembly may have a flange extending downstream from the periphery of the inlet to provide on either the interior or exterior surface of the flange a barrel seat for the tubular end of the barrel.

The barrel assembly may be provided with legs and a handle to facilitate carrying and use of an axial flow fan mounted within the barrel assembly.

A cabinet may be provided for axial flow fan assemblies which have a barrel of thin sheet metal or the like. The cabinet according to this invention encloses a barrel assembly in a manner so that the inlet and outlet of the barrel assembly is unobstructed. A closed cavity is defined between a barrel assembly and the interior surfaces of the cabinet. The closed cavity may be filled with a vibration-absorbing material. The material may have the characteristic which permits it to readily take on the shape of the exterior surface of the barrel assembly when the cavity is filled. The material can serve to structurally support the barrel assembly in the cabinet and absorb shock loads.

The filler material may be injected into the closed cavity subsequent to assembly of the cabinet around a barrel assembly. Expandable or expanded polymer foams are particularly suited for injection into the closed cavity.

BRIEF DESCRIPTION OF THE DRAWINGS

These and other objects, advantages and features of the invention will become apparent in the following detailed description of the preferred embodiments which are shown in the drawings wherein.

DETAILED DESCRIPTION OF THE PREFERRED EMBODIMENTS

Figure 1:
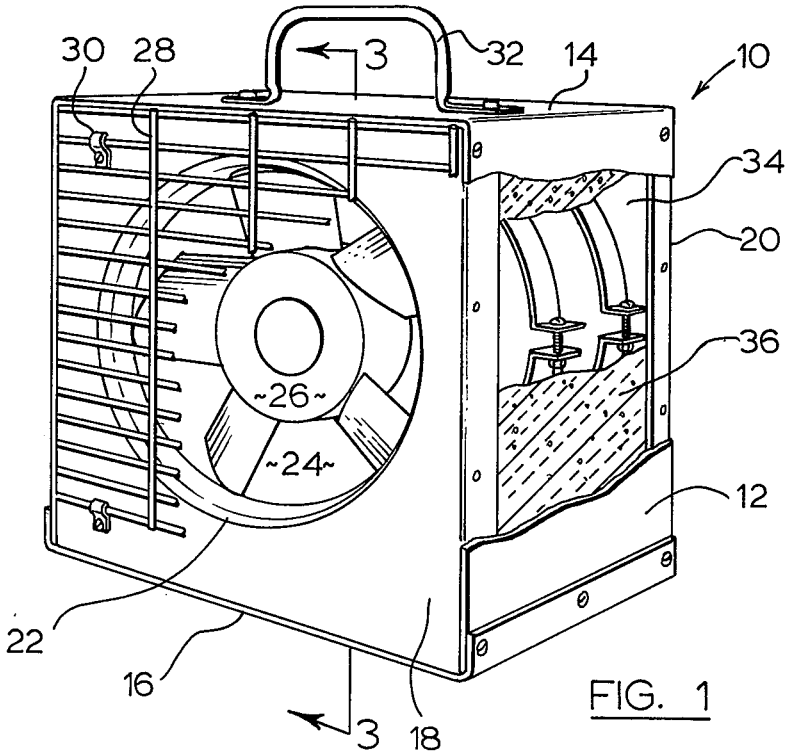
FIG. 1 is a perspective view of an axial flow fan insulated cabinet and barrel assembly with a portion of the grill and side wall of the cabinet removed.

A preferred enclosure according to the invention for an axial flow fan is shown in FIG. 1. The enclosure 10 has side walls 12, top and bottom walls 14 and 16, and front and rear walls 18 and 20. The front wall 18 has an inlet 22. A barrel assembly 24 houses an axial flow fan 26. The front wall 18 of the enclosure 19 may have a protective grill 28 fastened to it by clips 30. A handle 32 may be provided on the top wall of the enclosure. The enclosure 10 has a closed cavity 34 which is filled with a load-supporting, shock-absorbing and insulating type of material 36.

Figure 2:
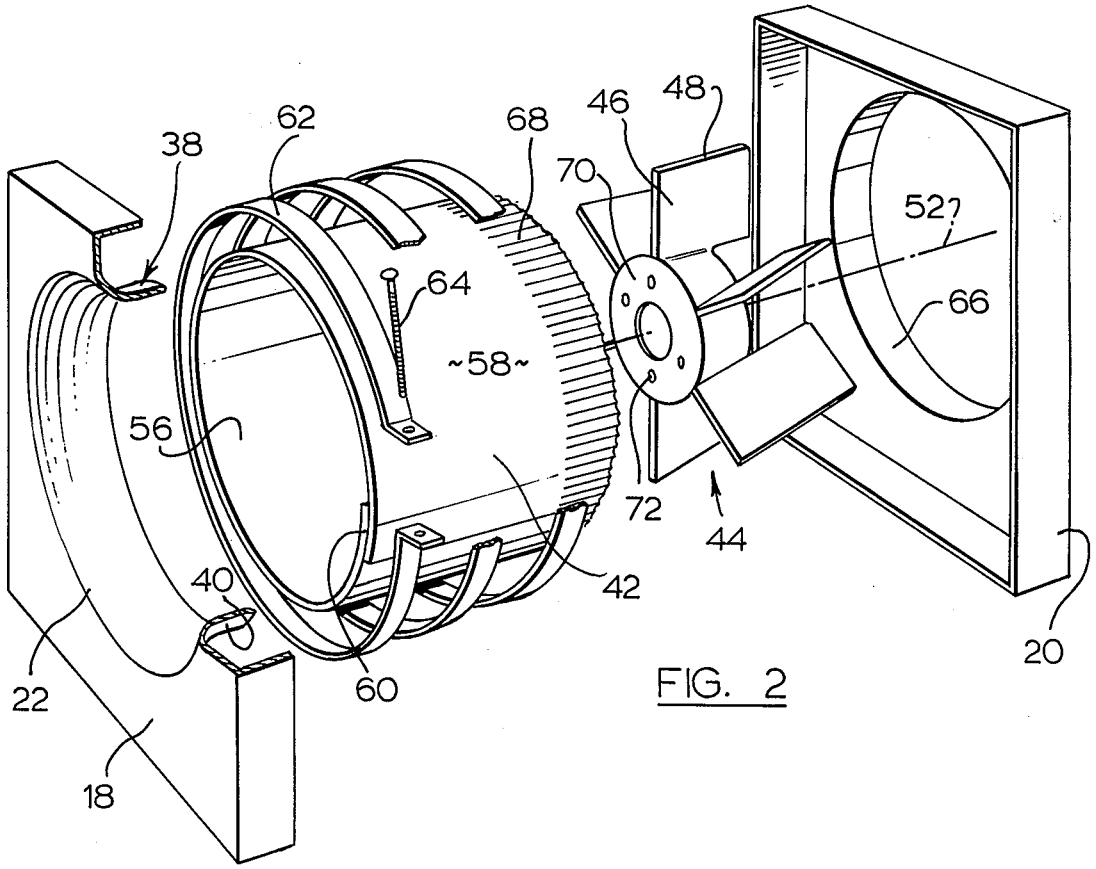
FIG. 2 is an exploded perspective view of a preferred barrel assembly according to this invention.

Referring to FIG. 2, the components of the barrel assembly are shown. The front wall 18 is a square or rectangular shaped body portion having a circular inlet 22. A barrel seat 38 extends downstream from the periphery of the inlet 22. The barrel seat 38 is an annular flange having an outer surface 40 which provides a barrel seat. The body portion 18 may be made from galvanized sheet metal. The inlet 22 with integral barrel seat 38 may be formed by a pressing operation, or by spinning the body portion 18 in accordance with accepted metal spinning practices. By far the step of pressing the metal is the least expensive method. During the pressing operation the inlet 22 must be formed symmetrically about its central axis.

The barrel assembly also includes a sheet of material 42 which may be galvanized sheet metal. The sheet metal 42 is wrapped around a vane assembly 44 having equally spaced-apart, radially-extending vanes 46. Each vane 46 extends radially an equal distance relative to the other vanes. The free ends 48 of all of the vanes are contained in a circle. The free ends 48 are planar and extend rearwardly and lie in planes which are substantially parallel to the longitudinal axis 52 of the barrel assembly.

The interior surface of the sheet metal 42 contacts the free ends 48 of the vane assembly. The so-formed tubular end 56 of the barrel assembly is fitted over or simultaneously wrapped around the exterior surface 40 of the barrel seat 38 so as to be in circular shape-holding relationship with the barrel seat. The circumference of the circle containing the free ends 48 of the vane assembly 44 is substantially equal to the circumference of the exterior surface 40 of the barrel seat 38 so that the so-formed barrel 58 is a hollow cylinder.

It is understood however, that the barrel seat 38 may be formed in several different ways where the barrel seat 38 regardless of its structure serves to retain the circular shape of the barrel 58 as defined by wrapping the sheet metal 42 around the free ends of the vane assembly 44.

In the embodiment shown in FIG. 2, a lap joint 60 is formed. The lap joint 60 may be spot welded subsequent to wrapping the sheet metal 42 around the vane assembly 44 to assist in retaining the tubular shape of the barrel 58. However, with a lap joint, the tip clearance of an axial flow fan is increased. In order to decrease the tip clearance, a butt joint for the sheet metal 42 may be formed where, in forming the butt joint, the sheet metal can be pre-rolled so that it readily conforms to the shape defined by the free ends 48 of vane assembly 44.

Separable hoop clamps 62 are provided. Hoop clamp 62 is constricted around the sheet metal 42 to hold it in position by tightening bolt and nut 64. A hoop clamp 62 is provided at end 56 of the barrel 58 to ensure that the sheet metal 42 conforms to the circular shape of barrel seat 38. Additional hoop clamps 62 are provided in the vicinity where the sheet metal 42 contacts the free ends 48 of the vanes 46. They are tightened around the sheet metal to cause it to take on a circular configuration defined by the free ends 48 of the vane assembly 44. The sheet metal 42 should be sufficiently resilient to take on a circular shape yet possess sufficient rigidity so that when the hoop clamps 62 are tightened around the sheet of material, the material still retains a circular configuration between the free ends 48 and the vane assembly 44. It is understood that when very flexible materials for sheet 42 are used, an increased number of vanes 46 may be required to decrease the circumferential distance between the free ends of adjacent vanes to thereby prevent distortion of the sheet of material 42 out of its circular configuration when it is wrapped and clamped around the vane assembly 44.

Figure 3:
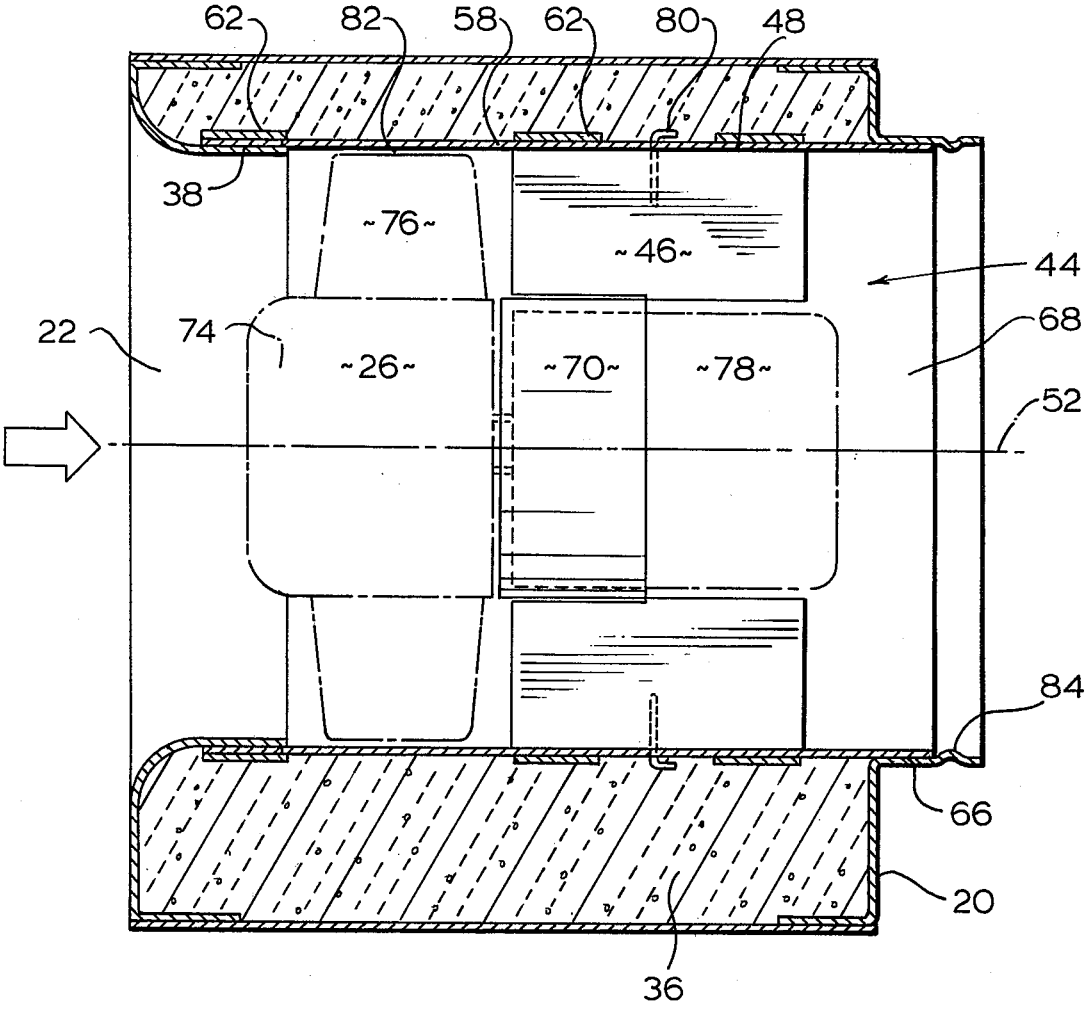
FIG. 3 is a section of the axial flow fan of FIG. 1 through lines 3—3 with the grill of the fan removed.

Once the barrel 58 is assembled on the vane assembly 48 and the body portion 18, the outlet 68 of the barrel assembly is fitted within outlet 66 of the end wall 20 in a manner more clearly shown in FIG. 3.

The vane assembly 44 has a hub 70 with holes 72 which permit mounting of an axial flow fan therein in the manner shown in FIG. 3. The vanes 46 of the vane assembly 44 are curved in a downstream direction to straighten the flow of the air as it leaves the fan 26. Such curvature of the vanes is determined in accordance with standard axial flow fan design practice.

Referring to FIG. 3, the axial flow fan 26 has a fan hub 74 with fan blades 76 mounted thereon. The fan motor 78 is mounted in the vane assembly hub 70. The longitudinal axis 52 of the vane assembly 44 is concentric with the central axis of the inlet 22. As shown in FIG. 3, the free ends 48 of the vanes 46 are planar and provide a flat surface on which the barrel 58 is secured by hoop clamps 62.

To overcome start-up inertia of the axial flow fan 26, pins 80 are provided which extend through the barrel 58 and are press-fitted into the vanes 46 to retain the vane assembly 44 in a secure position relative to the barrel 58. In addition to hoop clamp 62 around the barrel seat 38, the barrel 58 may be spot welded to the exterior surface of the barrel seat 38 to ensure that the barrel 58 does not separate from the barrel seat 38.

The barrel 58 is tubular because of the circular supporting surface provided by the barrel seat 38 and the support provided by the free ends 48 of the vane assembly 44. The tip clearance 82 between the fan blades 76 and the interior surface of the drum 58 may be reduced to a minimum of even 1/10 of a percent of the diameter of fan 26, particularly when the sheet of metal is butt joined. It is readily apparent in FIG. 2 that a barrel assembly is provided for an axial flow fan whose cost of manufacture is relatively inexpensive and is readily assembled to provide desirable minimum tip clearances.

The front and rear walls 18 and 20 are connected to the sides and top and bottom of the enclosure in the manner shown in FIG. 1. The outlet 68 of the barrel assembly may be crimped as shown in FIG. 2 to more readily fit in the outlet 66 of the end wall 20. Outlet 66 may be provided with an inwardly extending groove 84 which accommodates a clamp ring placed around an air duct which is attached to outlet 66. With the cabinet sides, top and bottom and ends secured to the barrel assembly in the manner shown, a closed cavity 34 is formed between the interior surfaces of the cabinet and the barrel assembly.

This closed cavity may be filled with a vibration- and shock-absorbing and load-supporting material 36 to provide an insulated cabinet which supports the barrel assembly in it. In a preferred embodiment, the material is an expanded rigid polyurethane foam which has been injected into the cavity. The foam may be injected into the closed cavity 34 through holes provided in the side or ends of the cabinet. Subsequent to setting of the polyurethane foam within the closed cavity, the holes may be closed off.

The rigid polyurethane supports the barrel assembly in the cabinet enclosure. The expanded polyurethane readily conforms to the exterior dimensioning of the barrel assembly within the cabinet enclosure and when the polyurethane sets, the entire barrel assembly is rigidly supported in all directions by the polyurethane within the enclosure.

The advantages of using a load-supporting material to insulate the cabinet are realized in that the barrel may be formed of relatively thin and inexpensive sheet metal. The expanded polyurethane foam which surrounds the barrel, supports it and ensures that the barrel retains its circular shape during use. When the barrel assembly is used in larger axial flow fans such as 15-inch diameter or more, the exterior surface of the barrel may be coated with an adhesive prior to injection of the polyurethane foam. The adhesive ensures that the polyurethane foam adheres to the surface of the barrel when the foam sets and during subsequent use of the fan so that the barrel assembly is always supported in the cabinet by the set polyurethane foam.

The use of load-supporting and insulating material in a cabinet for tube axial flow fans gives very acceptable results. In tube axial flow fans there may be only struts which support a motor in a barrel of this type of fan assembly. Usually such a barrel does not have sufficient structural strength to support the motor in the barrel. However, with use of an expanded rigid polyurethane foam in a cabinet for a tube axial flow fan, the rigid polyurethane foam supports the barrel and adds structural strength to it so that struts or straight vanes can be readily used to support a motor in the tube axial flow fan.

The amount of polyurethane foam injected into the cabinet may be regulated to the extent that when the foam sets in the cavity, a slight amount of pressure is exerted on the barrel extension by the foam to ensure a supporting of the barrel assembly in the cabinet by the expanded foam.

Aside from the types of polyurethane foams which expand after injection, another type of polyurethane foam may be used which is in the expanded state prior to its injection. The expanded foam is injected under pressure into the cabinet cavity. This type of expanded polyurethane foam may be obtained under the trade mark ISOSCHAM.

The rigid polyurethane foam readily absorbs noise generated by the tips of fan blades 76 during operation of the axial flow fan thereby resulting in a quieter fan. The fan may be readily used in ventilation of commercial establishments.

The foam readily absorbs any impact due to rough handling of the fan when used in portable operations. The fan may be dropped from a height of several feet without causing damage to the barrel assembly because the foam absorbs the impact without indenting the barrel assembly. The construction of the sides and ends of the enclosure 10 may be of heavy galvanized sheet metal to give a solid construction which can withstand abuse when used as a portable axial flow fan.

Although the insulated cabinet according to this invention is shown as being used with a preferred barrel assembly, it is understood that this type of insulated cabinet may be used with other types of axial flow fan barrels such as the tube axial flow fan to give the desired noise reduction, shock-absorbing and barrel-supporting features.

The axial flow fan enclosure according to this invention provides an economical enclosure which withstands abuse, has reduced noise generation and provides minimum fan tip clearances to give optimum axial flow fan ratings.

The insulated cabinet for axial flow fans also reduces heat gains or losses through the enclosure so that expansion and contraction of the axial flow fan barrel assembly is minimized by reducing the effect ambient temperatures have on the fan operation. This type of axial flow fan is therefore useful in air-conditioning and heating systems.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A barrel assembly for an axial flow fan comprising a sheet of flexible material, a body portion and a vane assembly, said body portion having a circular inlet and a barrel seat extending downstream from the periphery of said inlet, said vane assembly having a plurality of evenly spaced-apart radially extending vanes, said vanes each being of substantially equal radial length and each having a free end, the longitudinal axis of said vane assembly being coincident with the central axis of said inlet, said sheet of material being wrapped around said free ends of said vanes and said barrel seat, said barrel seat providing a seat which the formed tubular end of said sheet of material contacts, and means for retaining said sheet of material in position.

2. A barrel assembly of claim 1 wherein the circumference of the circle containing the free ends of said vanes is substantially equal to the circumference of said barrel seat, the formed tubular end of said sheet of material being positioned in contacting and shape-holding relationship with said barrel seat.

3. A barrel assembly of claim 1 wherein said barrel seat is a flange extending downstream from the periphery of said inlet.

4. A barrel assembly of claim 3 wherein said sheet of material is wrapped around said flange.

5. A barrel assembly of claim 1 wherein said sheet of material is sheet metal.

6. A barrel assembly of claim 5 wherein said sheet metal is overlapped when wrapped around the free ends of said vanes.

7. A barrel assembly of claim 5 wherein said sheet metal is butt joined when wrapped around the free ends of said vanes.

8. A barrel assembly of claim 1 wherein six vanes extend radially outwardly from said vane assembly.

9. A barrel assembly of claim 8 wherein the free end of each vane is planar.

10. A barrel assembly of claim 1 wherein said means for retaining said sheet of material in position comprises a plurality of clamps located on the exterior of said barrel assembly.

11. A barrel assembly of claim 10 wherein each clamp is a separable hoop having means for constricting the hoop about said sheet of material.

12. A barrel assembly of claim 11 wherein a hoop is provided exterior of the sheet of material at the location of said barrel seat and at least one hoop at the location of the free ends of said vanes.

13. A barrel assembly of claim 8 wherein said sheet of material as it is wrapped around said vane assembly is secured to the free ends of said vanes.

14. In an axial flow fan enclosure, a barrel assembly having an inlet and an outlet and a cabinet for said barrel assembly, said barrel assembly comprising a sheet of flexible material, and a vane assembly, said vane assembly having a plurality of evenly spaced-apart, radially-extending vanes, said vanes being of substantially equal radial length and each vane having a free end, the longitudinal axis of said vane assembly being coincident with the central axis of said inlet, said sheet of material being wrapped around said free ends of said vanes, and means for retaining said sheet of material in position around said vane assembly, said cabinet enclosing said barrel assembly with the inlet and outlet of said barrel assembly being unobstructed by said cabinet, the arrangement of said cabinet and said barrel assembly being such that a closed cavity is defined between the barrel assembly and the interior surfaces of said cabinet, said closed cavity being filled with a load-supporting, vibration- and shock-absorbing material which readily conforms to the shape of the external surface of said barrel assembly so that said barrel assembly is surrounded by said material and thereby supported in said cabinet.

15. In an axial flow fan enclosure of claim 14, said barrel assembly inlet being defined by a body portion having a circular inlet and a barrel seat extending downstream from the periphery of said inlet, said sheet of material being wrapped around said free ends of said vanes and said barrel seat, said barrel seat providing a seat which the formed tubular end of said sheet of material contacts, said means retaining said sheet of material in contact with said barrel seat.

16. In an axial flow fan enclosure of claim 15, the circumference of the circle containing the free ends of said vanes being substantially equal to the circumference of said barrel seat, the formed tubular end of said sheet of material being positioned in contacting and shape-holding relationship with said barrel seat.

17. In an axial flow fan enclosure of claim 14, said cabinet being rectangular in shape, one end wall of said cabinet having an inlet aligned with the inlet of said barrel assembly, the opposing end wall of the cabinet having an outlet, the outlet of said barrel assembly being aligned with the outlet of said outlet of the cabinet.

18. In an axial flow fan enclosure of claim 14 said material being an expanded plastic foam.

19. In an axial flow fan enclosure of claim 18 said expanded plastic foam being an expanded rigid polyurethane foam.

20. In an axial flow fan enclosure of claim 13 said sheet of flexible material being sheet metal, the enclosure walls being formed of sheet metal.

21. In an axial flow fan enclosure of claim 14 said barrel seat being provided by a flange extending downstream from the periphery of said inlet.

22. In an axial flow fan enclosure of claim 21 said sheet of material is wrapped around said flange.

23. In an axial flow fan enclosure of claim 22 said sheet of material being sheet metal, said sheet metal being overlapped when wrapped around the free ends of said vanes.

24. In an axial flow fan enclosure of claim 22 said sheet of material being sheet metal, said sheet metal being butt joined when wrapped around the free ends of said vanes.

25. In an axial flow fan enclosure of claim 14 said vane assembly having six vanes extending radially outwardly.

26. In an axial flow fan enclosure of claim 25, the free end of each vane being planar.

27. In an axial flow fan enclosure of claim 14 said means for retaining said sheet of material in position comprises a plurality of clamps exterior of said barrel assembly.

28. In an axial flow fan enclosure of claim 27, each clamp being a separable hoop having means for constricting the hoop about said sheet of material.

29. In an axial flow fan enclosure of claim 25, said sheet of material as it is wrapped around said vane assembly being secured to the free ends of said vanes.

30. In an axial flow fan enclosure of claim 28, at least one hoop being provided exterior of the sheet of material at the location of the free ends of said vanes.

* * * * *